US005906865A

United States Patent [19]

Ellermeier et al.

[11] Patent Number: 5,906,865

[45] Date of Patent: May 25, 1999

[54] PROCESS AND APPARATUS FOR REDUCING TURBULENCE DURING CURTAIN-COATING

[75] Inventors: Wolfgang Ellermeier, Darmstadt; Markus Schäfer, Nierstein, both of Germany

[73] Assignee: AGFA-Gevaert, N.V., Mortsel, Belgium

[21] Appl. No.: 08/896,784

[22] Filed: Jul. 18, 1997

Related U.S. Application Data

[63] Continuation of application No. 08/628,115, Apr. 4, 1996, abandoned.

[30] Foreign Application Priority Data

Apr. 10, 1995 [DE] Germany ..... 195 13 531

[51] Int. Cl.[6] ..... B05D 1/30; B05B 13/02

[52] U.S. Cl. ..... 427/420; 118/324; 118/325; 118/DIG. 4

[58] Field of Search ..... 427/420; 118/324, 118/325, DIG. 4

[56] References Cited

U.S. PATENT DOCUMENTS

| | | | |
|---|---|---|---|
| 4,060,649 | 11/1977 | Coleman | 427/79 |
| 4,135,477 | 1/1979 | Ridley | 118/325 |
| 4,479,987 | 10/1984 | Koepke et al. | 427/402 |
| 4,559,896 | 12/1985 | Bossard et al. | 118/300 |
| 4,830,887 | 5/1989 | Reiter | 427/420 |
| 4,879,968 | 11/1989 | Denz et al. | 118/300 |
| 5,328,726 | 7/1994 | Reiter | 427/420 |

FOREIGN PATENT DOCUMENTS

| | | | |
|---|---|---|---|
| 0 115 621 A2 | 8/1984 | European Pat. Off. | G03C 1/74 |
| 0 606 038 A1 | 7/1994 | European Pat. Off. | G03C 1/74 |
| 0 425 562 B1 | 11/1994 | European Pat. Off. | B05C 5/00 |
| 32 41 831 A1 | 5/1984 | Germany | B05D 7/04 |
| 3241831 | 5/1984 | Germany . | |
| 1 518 552 | 7/1978 | United Kingdom | B05C 5/00 |

*Primary Examiner*—Shrive Beck
*Assistant Examiner*—Michael Barr
*Attorney, Agent, or Firm*—Breiner & Breiner

[57] ABSTRACT

Non-uniform liquid flows in the curtain limit the process speed and cause defects during coating. These liquid streams are equalized by auxiliary liquids in the curtain holder. If the curtain edge is separated by a free jet of a separating liquid, turbulence in the curtain edge is isolated from the curtain center. The maximum attainable speed is increased. Because the free jet also removes liquid from the curtain in the penetration area, a beaded edge is not generated on the base, and it is possible to coat uniformly thick to the outer edge of the base. The process is especially suitable for making photographic films.

17 Claims, 10 Drawing Sheets

PROCESS AND APPARATUS FOR REDUCING TURBULENCE DURING CURTAIN-COATING

This is a continuation of application Ser. No. 08/628,115 filed Apr. 4, 1996, now abandoned.

BACKGROUND OF THE INVENTION

1. Field of the Invention

The invention involves a process and a curtain-coater for coating a base by means of a free-falling liquid curtain comprising a coating solution. This process has long been known as the curtain-coating process. In this process, a base in the form of a web is moved continuously by a transport device through a coating zone and is thereby coated with one or more layers either wholly or partially by the free-falling liquid curtain.

2. Description of the Related Art

In the photographic products industry, this process is used, for example, to apply photosensitive and photoinsensitive coatings. These coatings comprise mostly multiple layers formed from aqueous coating solutions, which are coated as layer composites in the liquid state onto the base. The base is mostly a synthetic resin film one to two meters wide or a paper web. The coated base then passes though a drying device in which the coating solution is dried. The dry film web is wound up. At this point, the edges of the web must be dry or else the individual layers of the roll will adhere. During coating, a troublesome beaded edge forms most of the time and is vacuumed away immediately after coating.

In the curtain-coating process, a coating head, called coater for short, prepares the layer composite. The coater has an inclined slide surface containing coating slots. The coating solution issues from the coating slots and flows along the slide surface to a so-called coating lip. The layer composite leaves the coating lip and falls freely as a liquid curtain onto the base.

The process speed is limited primarily by breaks in the liquid curtain. Surface tension tries to narrow the curtain. This is prevented by so-called curtain holders, which guide the curtain at its edges and keeps it spread during the free fall. These curtain holders are also called edge guides, side guides, or side holders. The speed of the liquid flow in the margin layer next to the curtain holder is lower than the speed in the middle of the curtain. The margin layer near the curtain holders becomes displaced. The flow lines near the curtain holders do not run vertically straight but are curved. This results in the liquid curtain having areas that are thinner than in the middle. These areas are also called areas of "contraction". They are narrowed areas in the liquid curtain, they run inclined to the curtain holder, and at the lower end of the curtain holder are spaced apart by four to eight mm. They are the weak spots in the curtain. When the coating process fails, the curtain breaks predominantly at these areas of contraction. One cause of this breaking action is the flow at the lower end of the curtain holders. Turbulence originating in this area spreads to the above-cited weak spots and leads to breakage of the liquid curtain. Attempts have been made to reduce this undesired displacement action. For example, the curtain holder is wetted with an auxiliary liquid. This auxiliary liquid is thinner than the coating solution. The auxiliary liquid lubricates the area of the curtain bordering the curtain holder and thus reduces the speed differential. The shape of the curtain holder, its geometry, and the selection of construction material also influence flow behavior in the margin layer. Various curtain holders are known in the current state of the art, for example, a wire form in U.S. Pat. No. 5,328,726, a bar form in U.S. Pat. No. 4,830,887, a flat form in U.S. Pat. No. 4,135,477 and GB 1 518 552, and a porous circular form in EP 0 115 621.

The curtain in the curtain-coating process can be wider or narrower than the base. EP 0 425 562 describes a curtain-coating process in which the liquid curtain is wider than the base. A separating device separates a curtain edge on both sides and removes the edges from the coating zone. The separating device comprises essentially a flat, cantilevered blade. This blade projects from a vacuum housing and interrupts the free fall of the curtain in the immediate vicinity of and parallel to the base. The interruption occurs just before the curtain lands. The blade is thin and sharp. It is rinsed on its upper side by a cleaning liquid. The stream of cleaning liquid rinses the liquid of the curtain edges out of the coating area. If the curtain edges comprise a gelatin solution, only part of the valuable coating solution is lost, but this process has many disadvantages. One is a crust that accumulates on the edge of the blade during long operation. This is caused by gelatin residues. Thus, the blade becomes dull. A dull blade cannot satisfactorily prevent a beaded coating on the edge. An improved embodiment of this invention, in which a cleaning liquid rinses the underside of the knife, also has disadvantages. Turbulence in the liquid flow at the lower ends of the curtain holders is not adequately isolated from weak spots in the curtain. Furthermore, flow on the underside of the blade is always unstable. Fundamentally, the cantilevered, sharp-edged blades pose an ever-present risk to the operators. Cleaning the blades can result in injuries. The thin blades can be easily bent and damaged. This can lead to stoppages in the coating operation.

EP 0 606 038 discloses a curtain-coating process in which the liquid curtain is narrower than the base. The curtain edge falls on a projecting flat blade and is vacuumed away from there. Only the middle section of the free-falling curtain lands on the base. The flat blade must also be very thin to achieve the desired improvement in the edge of the coating. Only a sharp thin blade positioned just above the base minimizes the beaded edge of the coating. Here, too, the edge of the blade also becomes encrusted during operation. Therefore, the coating becomes uneven at the edge which results in turbulence.

The fundamental goal in film manufacture is to use material as efficiently as possible. The base should be coated as uniformly as possible up to the edges. Furthermore, the manufacturing process should not be susceptible to defects during the production time for one batch, which can last, for example, up to one day. The curtain-coater should present the least possible risk for operators during equipment cleaning.

SUMMARY OF THE INVENTION

The invention involves the problem of improving process speed in the known curtain-coating process so that, also at high speeds, the liquid curtain is insensitive to turbulence associated with flow near the curtain holders. The invention also involves the problem of ensuring the most uniform possible coating up to the edge of the base. Another problem involved in the invention is to increase coating quality at high speeds, that is, to reduce coating defects, such as, for example, streaks and sporadic fortuitous defects in coating. A further problem involved in the invention is to provide a curtain-coater that performs the process in a manner not susceptible to turbulence during a manufacturing operation and that can be used safely by the operators.

These problems are solved in the present invention.

The invention starts from the point that, at high coating speeds, it is advantageous not to sever the curtain edges by a rigid surface in the form of a knife or a deflector plate, but rather to penetrate the plane of the curtain in a penetration zone and thus separate the curtain edges. The penetration is accomplished preferably by a free jet of a separating liquid. Thus, in the immediate vicinity of the penetration zone, both the center part of the curtain and the part facing the separating element are free-falling. If the penetration area of the curtain is as close as possible to the base and in the contraction area, the center of the curtain is largely undisturbed. This manner of separating the curtain edges decouples, as completely as possible, turbulence originating on the contact line near the curtain holder from the free-falling center of the curtain. It was found, surprisingly, that the use of a free jet as the separating element eliminates in practice the effect of edge turbulence on the center of the curtain. This is especially important at high coating speed with a thin liquid curtain. In this case, the curtain is especially susceptible to turbulence originating at the edge near the curtain holder. At high coating speeds, it is frequently observed in the heel of the liquid curtain that portions of the liquid detach from the curtain. So-called "cylindrical or spherical drops" are formed. These drops move freely in the vicinity of the curtain contact line. If such a drop lands on the curtain, a defect can form in the coating structure. For example, the drop can cause streaks or sporadic defects in the coating structure. These flow splashes are not observed in the invention's separating curtain-coater. Coating defects are reduced.

It was surprising to the expert that a free jet of a separating liquid can separate the curtain edges directly over the base so that the free-falling curtain center is not disturbed and there are no splashes on the coating. The jet must be as thin as possible to be able to separate the liquid curtain edges carefully and directly over the base. A water jet to use for a separation step is, for example, known in the water jet cutting of solid structures. There, water jets having a jet diameter of about 0.2 mm and very high nozzle speeds are used to cut metal and plastics. However, for the present problem, high nozzle speeds are not only not required, but can also be troublesome. Separating the liquid curtain edges reaches the desired result only if the free jet is operated below a certain propulsion rate. Only if the jet speed is below a certain threshold can the free-falling curtain edges be separated without turbulence. If the flow speed of the liquid jet is too high, the air stream entrained in the free jet is so great that it can lead to vibrations in the entire curtain. At a certain jet speed, the free jet tears off portions of the liquid from the curtain. These cause turbulence in the coating. On the other hand, a specific minimum speed is required for the separating liquid to prevent the free jet from being bent by gravity. Therefore, a certain minimum in the free jet's flow speed is required for it to have the straightest possible line of flow for a specific distance. The free jet must also have straight line flow after penetrating the curtain. The separating step is effective only if the jet is applied as close as possible to the base.

It was particularly surprising that coating quality is improved at the edge, if the curtain edges are separated by a liquid. It was demonstrated surprisingly that practically no thick edges occur on the base and the coating edge is straight. The base can be coated up to the outermost edge. It is frequently not necessary to vacuum off the edge. There are lower losses in finishing film, that is, in cutting for specific film formats. This means that the material is better utilized.

The current state of the art for curtain-coating shows no disclosure on using a free-flowing liquid to separate curtain edges. Rather, the art involves solid structures that are mostly blade-like and are used either inclined or perpendicular to the free-falling liquid curtain. They fulfill simultaneously a separating and a disposal function. Thus, for example, U.S. Pat. No. 4,879,968 discloses the use of a pointed cutting blade in the edge area of the curtain. In EP 606 038, the blade acts as an interceptor. The rigid deflecting area intercepts the curtain edge before it contacts the base. The blade also guides the separated liquid of the curtain edge to a vacuum outlet.

Compared to the current state of the art, the invention's free jet operates primarily as a separating member. It separates the liquid curtain into a center curtain area that drops freely to coat the base and into two curtain edges that are diverted before contacting the base. The action of the free jet is different. In the penetration zone, the free jet separates liquid from the curtain. It mixes the coating solution of the liquid curtain with the separating liquid of the free jet. The kinetic energy of the free jet picks up the liquid separated from the curtain and carries it away from the curtain. As a result of this removal of liquid, the curtain is thinner near the penetration zone. Consequently, the edge of the free-falling curtain center is also thinned. This thinner edge minimizes bead formation in the coating. Because the remaining drop distance of the curtain center is very small, the narrowing due to surface tension hardly causes thickening along the remainder of this drop distance. The result is that the curtain center coats the base uniformly to the edge. Because the free jet does not become encrusted like a solid structure, this advantageous separating effect remains unchanged during long production runs.

It is also advantageous that the separated curtain edge, while guided at the curtain holder, moves farther in a free-fall fashion after the penetration zone. The separation process hardly disturbs the curtain. The penetration zone affected by the invention's separating jet is smaller than any other known separating method. An inclined plane as used in the current state of the art is not required in the invention to keep the curtain edge away from the base.

Within the scope of the present invention, the term "free jet" refers to a liquid stream, having a constant speed profile and any cross-section, which flows a distance in space without being spatially confined.

The term "penetration zone" refers first to that area in the plane of the liquid curtain where the free jet penetrates. Viewed three-dimensionally, it pierces the penetration zone. The free jet pierces the finitely thick liquid curtain. Thus is also formed a three-dimensional contact area between the cutting liquid and the curtain liquid. Both liquids mix in this area. The term "penetration zone" also refers to this three-dimensional area of contact between the liquids.

The term "curtain edges" designates side strips of the free-falling liquid curtain. These curtain edges wet the adjacent curtain holders lengthwise, are four to eight mm wide, and shape lengthwise the narrowing designated as contraction.

The term "high coating speeds" refers to coating with photographic coating solutions at a web speed from 250 m/min. This term also includes lower web speeds in the case of extremely thin liquid curtains for low wet coating weights.

An advantageous embodiment of the invention is a free jet having a circular cross-section. This jet shape can be formed by a thin-wall tube having a circular end as a nozzle and positioned above the base. It is advantageous to have the direction of the free jet parallel to the travel direction of the base. Then, it is possible, also with flat curtain holders, to position the penetration zone in the immediate vicinity of the base and near the curtain holder. A distance from the free jet to the base of about 0.5 mm and a distance of less than 5 mm from the curtain holder have proved to be particularly desirable in practice. This achieves an optimum result with a circular free jet. Turbulence is then effectively suppressed in the edge area of the flow at the foot of the curtain holder. Furthermore, the separating step itself does not cause turbulence in the center of the curtain.

It is further advantageous if the free jet impinges on the liquid curtain at a flow speed greater than the drop speed of the curtain. A flow speed five times the drop speed has proven to be optimum. At this flow speed for the free jet, the liquid curtain is separated uniformly in the penetration zone without being adversely affected by the air boundary layer entrained with the free jet. With liquid curtains, which are customary in the photographic industry, the upper limit for free jet flow speed is about 15 times the drop speed of the curtain.

It is also advantageous to have the direction of the free jet be the same as the travel direction of the base. Thus, turbulence in the separating step does not affect the curtain center.

The thinnest possible jet is required for the separating step. Selection of the diameter depends on the thickness of the curtain, the Reynolds number for the throughput per unit of width, and the speed of the curtain and of the free jet:

$$\frac{Hc}{Hs} \approx f(Re) \cdot \left(\frac{Vs}{Vc}\right)^2$$

wherein Hc=thickness of the liquid curtain in the penetration zone

Hs=diameter of the free jet

Re=Reynolds number

Vs=flow speed of the free jet

Vc=drop speed of the curtain in the penetration zone

As this equation shows, the separating action of the free jet does not depend on the surface tension of the coating solution. It was found that, with photographic coating solutions, a free jet having a diameter about twice the thickness of the curtain is optimal for the separating step. The mass flow of the free jet is about 0.1 l/min.

It is desirable to have the penetration zone in the contraction area. There, the curtain has its weakest spot, and so the separating step can take place very smoothly.

A particularly simple and, hence, advantageous embodiment of the invention is obtained if the separating element is a thin cylindrical bar. This permits largely isolating the turbulent edge flow from the curtain center. Although liquid is not removed here, in contrast to the free jet in the penetration zone of the curtain, the beaded edge is minimized here compared to the state of the art.

The free jet can be, for example, a water jet. A mixture of seven parts of water and three parts of alcohol has proven to be particularly favorable in practice. Wetting agents other than alcohol, as are customary in photographic coating processes, can also be used. It was also found that wetting agents in the separating liquid further reduce thickening at the edge. This is due to the coating solution spreading in the edge area. The temperature of the separating jet is preferably about equal to the temperature of the curtain. Because of the liquid curtain, the ambient air at the free jet nozzle is saturated with the solvent in the coating solution, for example, water. An equal temperature for the coating solution and the separating liquid avoids condensation.

The present invention starts from the point that the free jet can act directly as interceptor. If the free jet is built flat, it is in a position to penetrate the curtain edge immediately above the base, to divert it convectively, and to keep turbulences away from the curtain. The maximum attainable speed is increased. The edge of the coating also runs uniformly and without a bead. The base can be coated up to its outermost edge. A maximum output speed of about 30 m/min was found in practice. Up to this jet speed, the separating step proceeds so that the air interface entrained with the free jet does not act adversely on the liquid curtain.

A curtain-coater for performing the process uses a free jet that penetrates the curtain as closely as technically possible above the coating side of the base. Thus, two free-falling curtain parts form in the area of the penetration zone. One part, the two edges of the curtain, is at the curtain holders. A vacuum device removes these curtain edges before they can coat the base. The other part, the center of the curtain, coats the base. The vacuum device has an aperture through which the edges of the curtain are sucked away and optionally, the auxiliary liquid. The aperture can be varied, according to the shape of the curtain holder. For example, a flat curtain holder can have a lateral slot, a round curtain holder, a hole on the front side. It is important for the vacuum aperture to be as close as possible to the base, most preferably at a distance of less than 0.5 mm. It is further advantageous to design the vacuum device so that its contour is adapted to the air stream being vacuumed away. The curtain holder in one embodiment of the invention has sloping surfaces. The bottom wall of the housing is inclined at the contact point with respect to the tangential plane.

If an auxiliary liquid assists in wetting the curtain holder, better adhesion in the curtain holder is obtained in addition to the drop velocities being equalized as mentioned earlier. In particular, if the auxiliary liquid forms, in a flat curtain holder, a straight, free-flowing, liquid stream, the curtain is especially stable.

A slope in the curtain holder also improves the stability of the curtain at high coating speeds. If the inner surfaces of the curtain holders are tapered with respect to each other, the contraction is lower. The weak spots in the curtain are strengthened.

In particular, an advantageous distance was found for the spacing from the invention's free jet to the base and to the curtain holder. It is favorable for the spacing B to the base and the spacing A to the curtain holder to satisfy the following relationship:

$$0 < B/A \leqq 5$$

Many devices are available to the expert for producing the free jet. Devices to generate pressure are usually pumps. The jet nozzle can be a simple end of a tube. In this case, the separating liquid emerging from the end of the tube forms a cylindrical jet. The free jet length is that path length that the jet of separating liquid streams through freely. The jet nozzle forms the beginning of this path. The construction determines the end of the path, for example, a part of the housing for the collecting device, thus a fixed structure. The free jet flows against this structure, where the jet encounters a so-called deflector. It is advantageous from a construction standpoint to have the beginning and end of this path positioned over the base and to have the free jet travel in the same direction as the base travels. A free jet length of about two to four centimeters has been proven to be desirable with the use of flat curtain holders. The top limit for this path is where the jet begins to widen, thus, where the free jet flow is no longer laminar. A widened jet having an external shape that can no longer be preset is not suitable for the separation. The distance from the free jet to the base must then be increased. The penetration zone in the curtain is not under control. The lower limit is the result of the following finding. At high coating speeds, the curtain attempts to warp out of its planar form. Flat curtain holders also permit a tilt in the curtain away from vertical. The cause for this is the air interface with the web. A free jet length of three centimeters gives the curtain the required free play in travel. On the other hand, the contour of the free jet is still specified accurately enough.

As already stated, the deflecting wall can be part of the vacuum device, for example, a curved metal sheet. It can be made of the materials normally used in coating devices for photographic emulsions. Titanium alloys or stainless steel are preferred. The housing for the vacuum device can be made of synthetic resin.

Generating the free jet and using it as a separating element poses no danger for operating personnel. The liquid pressure required to penetrate the curtain is entirely harmless. The risk of injury during cleaning of the installation is extremely low. The invention's separating device has no projecting blade-like parts. The vacuum device, as shown by the embodiment in FIG. 5, is constructed so that cleaning the installation does not create an injury risk. The vacuum device is easy to mount on the curtain holder. The risk of damaging the device during cleaning and maintenance is low. The curtain holder can, for example, be designed as a sturdy metal plate screwed onto the coater.

BRIEF DESCRIPTION OF THE DRAWINGS

The invention is described in more detail with the aid of the accompanying drawings described as follows.

DETAILED DESCRIPTION OF THE INVENTION

Figure 1:
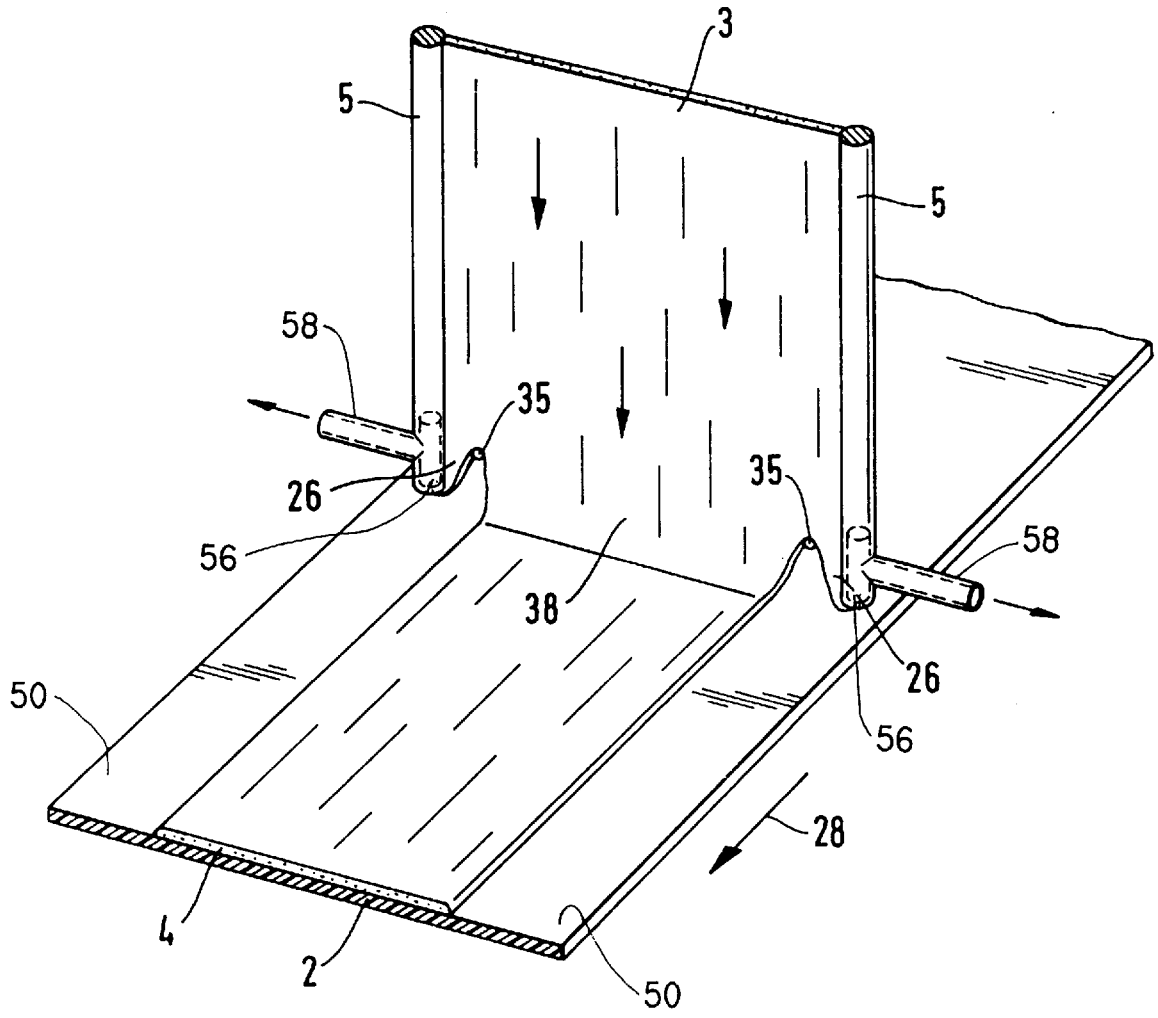
FIG. 1 shows a three-dimensional view of a liquid curtain falling freely on a base, which is wider than the curtain.

Throughout the following detailed description, similar reference numerals refer to similar elements in all Figures of the drawings.

In FIG. 1, a free-falling liquid curtain 3 is coating a base 2 moving in the direction of the arrow 28. The liquid curtain 3 is narrower than the base 2. The liquid curtain 3 is held between curtain holders 5. Immediately before the curtain lands on the base 2, curtain edges 26 are separated in a penetration zone 35. A free-falling curtain center 38 and the free-falling curtain edges 26 are formed. The curtain center 38 forms a coating 4 on the base 2 and leaves an uncoated area 50 on both sides of the base 2. The free-falling curtain edge 26 is vacuumed away at the foot of the curtain holder 5 through an aperture 56 and an outlet 58, as shown in greater detail in FIG. 7. For the sake of convenience, throughout the specification reference may be made to a single curtain edge 26, but it is to be understood that there are two curtain edges 26. For simplicity, in this figure a vacuum device and a coating head are not shown. A separating element is not shown in detail but it can be a thin free jet of a separating liquid or a thin bar that penetrates the curtain 3 just above the base 2 and separates the curtain edges 26.

Figure 2:
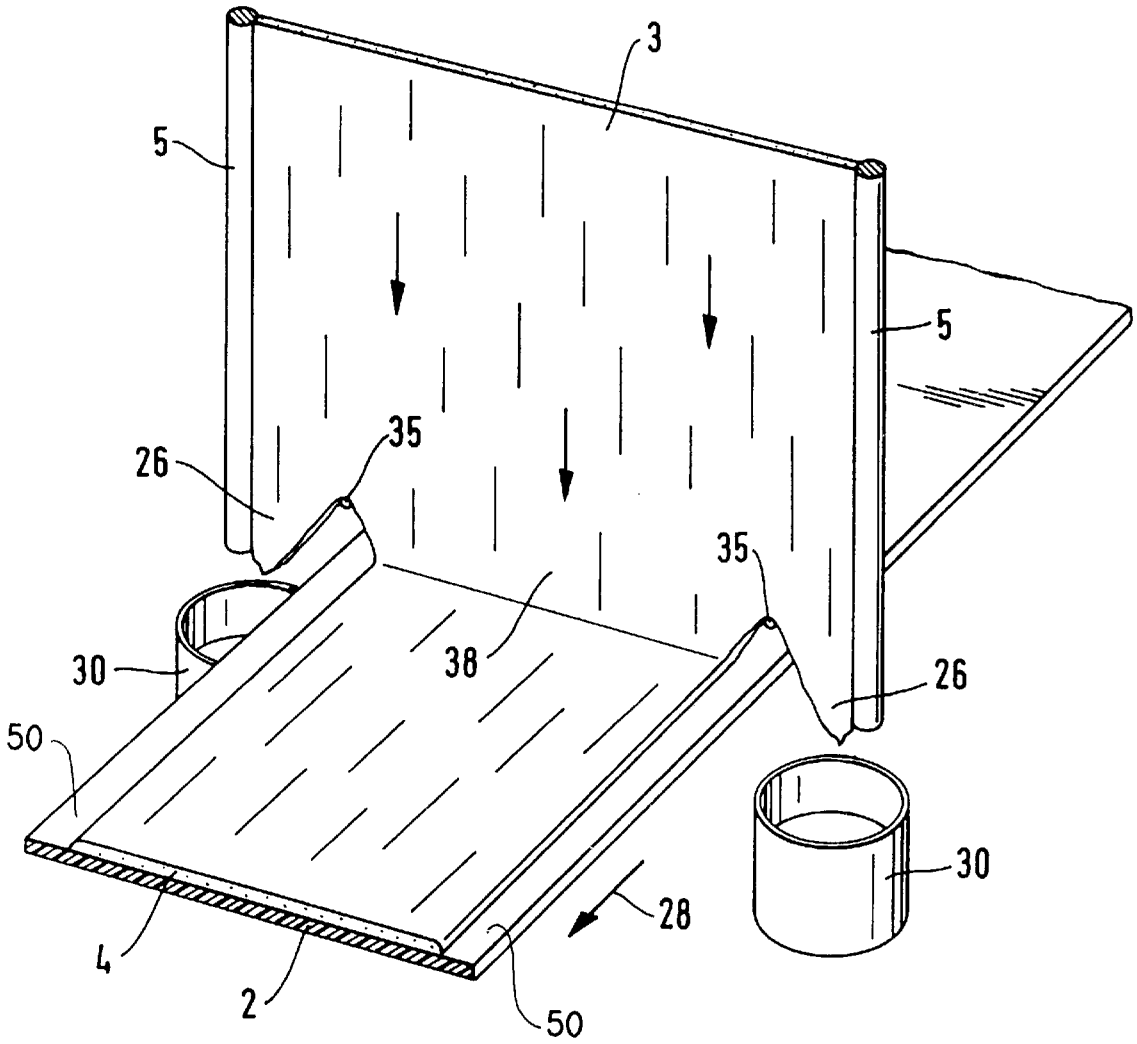
FIG. 2 shows a three-dimensional view of a liquid curtain falling freely on a base, which is narrower than the curtain.

In FIG. 2, the free-falling liquid curtain 3 is coating the base 2 moving in the direction of the arrow 28. The liquid curtain 3 is wider than the base 2. The curtain holders 5 spread the curtain 3. The curtain edges 26 are severed in the penetration zone 35. The free-falling curtain center 38 and the free-falling curtain edges 26 are formed. The curtain center 38 forms the coating 4 on the base 2 and leaves the uncoated areas 50 on both sides of the base 2. The free-falling curtain edges 26 drop into containers 30. For simplicity, a coating head and a separating element are also not shown here.

Figure 3:
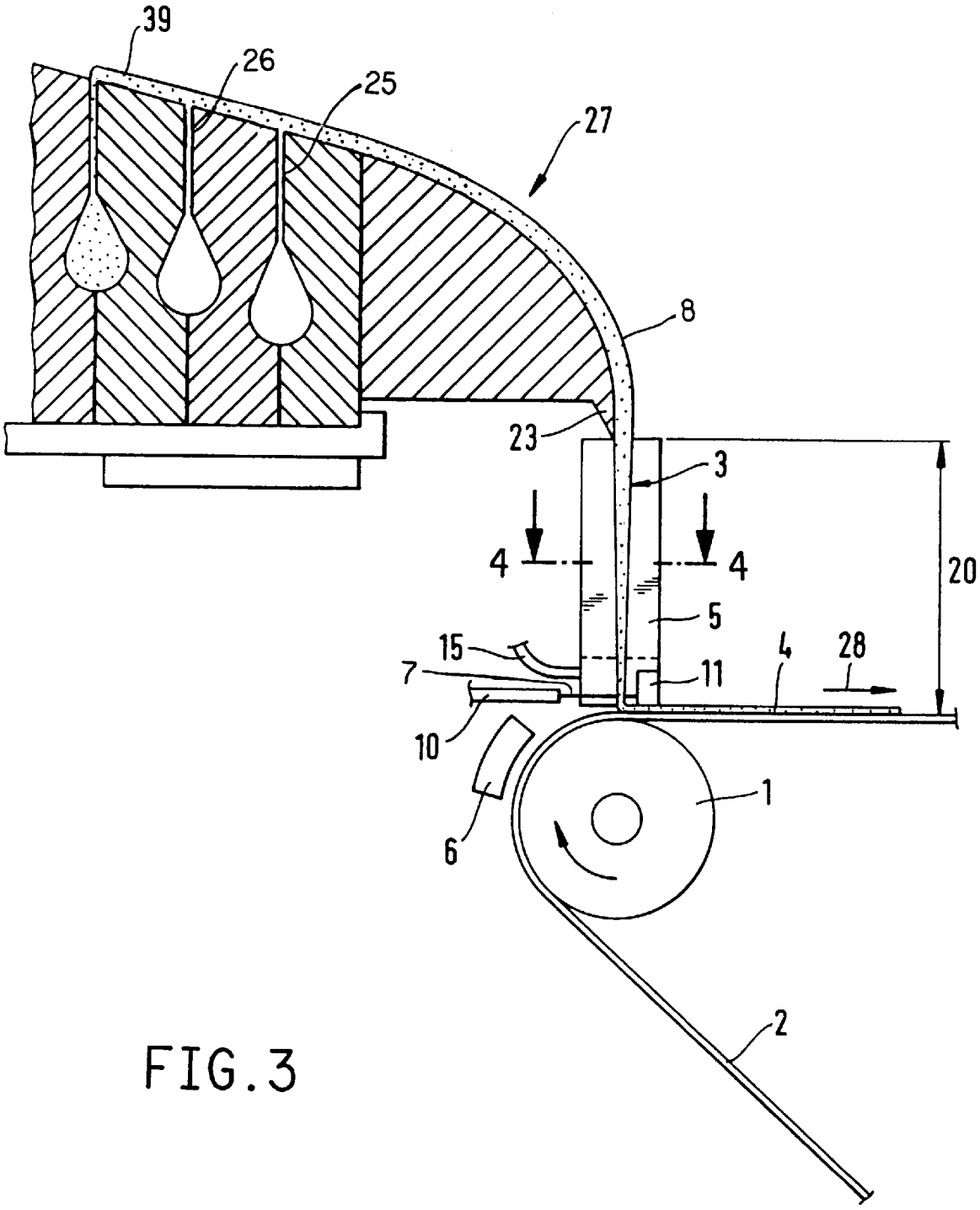
FIG. 3 shows a side view of a curtain coater in a partial cross-section.

FIG. 3 shows a coating head 27, from a coating lip 23 of which a layer composite (not shown) forms the free-falling liquid curtain 3 that drops onto the base 2 to be coated. The layer composite is formed from coating solutions emerging from two coating slots 25 and 26. However, the layer composite can comprise more than two layers. The drop height 20 is usually between 3 to 20 centimeters, preferably more than 15 centimeters for high coating speeds. The base 2 is forwarded by a transport device 1, which, as shown here, also serves as a coating roller. The curtain 3 is held by flat curtain holders 5. A coating slot 39 can feed an auxiliary liquid 8 onto a side of the inclined surface of the coating head 27. Although not shown, a similar slot for feeding an auxiliary liquid would be at the other side of the inclined surface of the coating head 27. Another possibility (not shown) is a nozzle that feeds an auxiliary liquid onto the inclined surface. A free jet 7 used to separate the curtain edges 26 issues from a nozzle 10, penetrates the plane of the curtain 3 and impacts on a deflector 11. This collects the separating liquid and passes it to a vacuum line 15. This figure also shows a vacuum device 6, which removes the air interface entrained with the base 2.

Figure 4:
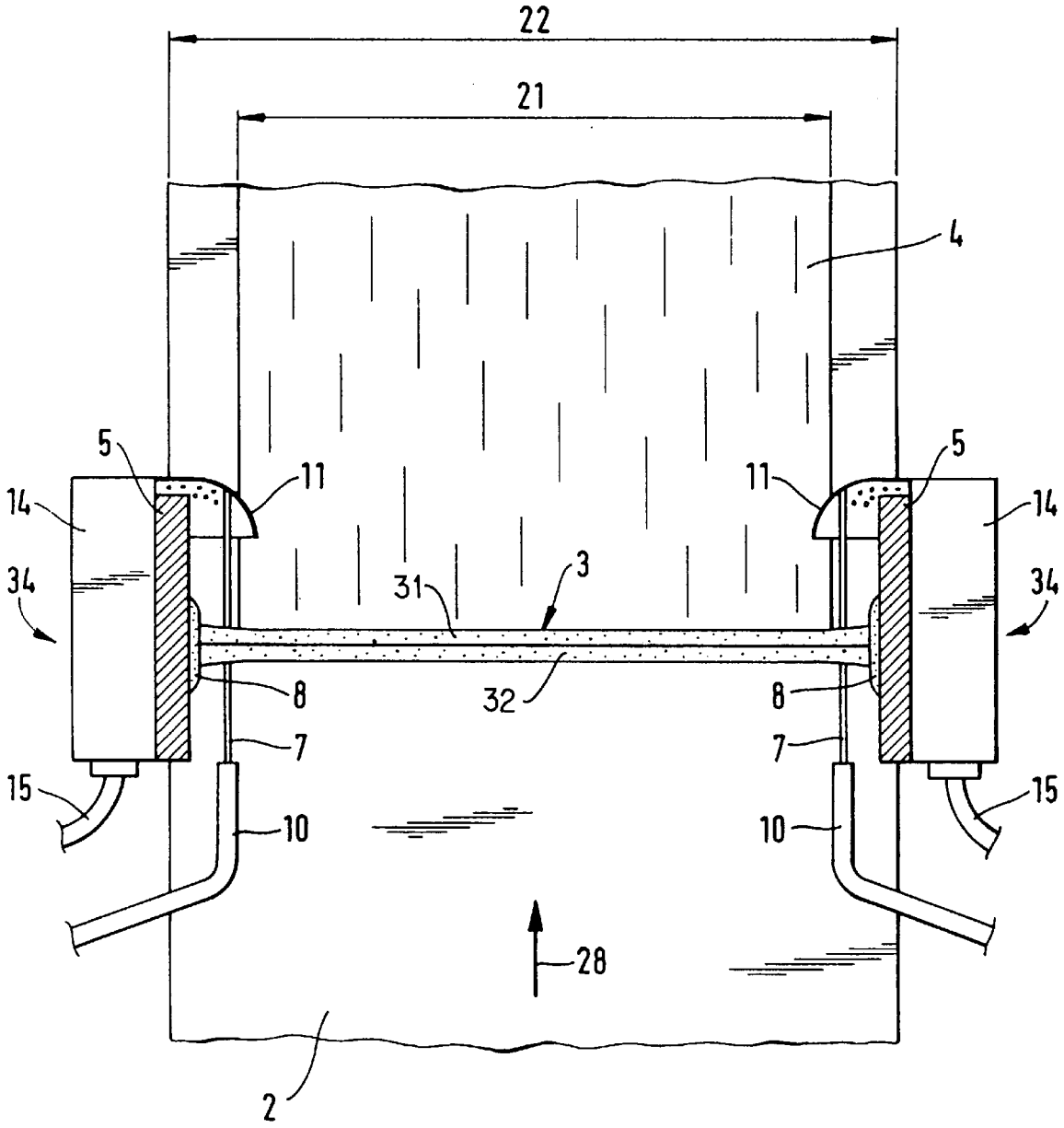
FIG. 4 shows a transverse section along the line 4—4 in FIG. 3.

FIG. 4 shows a transverse section along the line 4—4 of FIG. 3. The curtain 3 comprises two layers 32, 31 which were formed from solution emerging from the coating slots 25 and 26. Due to the auxiliary liquid 8, the layers 132, 131 wet the curtain holders 5. The base width 22 is wider than the coating width 21. The free jet 7 runs essentially parallel to the travel direction 28 of the base 2. The free jet 7 is spaced preferably less than 5 mm from the curtain holder 5 and is about 2 to 4 cm long, preferably 3 cm. The free jet 7 flows through this distance and impinges on the deflector 11. From there, it reaches a vacuum device 34. The deflector 11 can be a bent metal plate as shown, but any shape is possible to guide the free jet 7 to the vacuum device 34. The severed liquid edge 26 is removed together with the auxiliary liquid 8 by the vacuum device 34. A housing 14 of the vacuum device 34 is attached to the curtain holder 5. A vacuum line 15 connects the vacuum device 34 with a device to reduce pressure, not shown.

Figure 5:
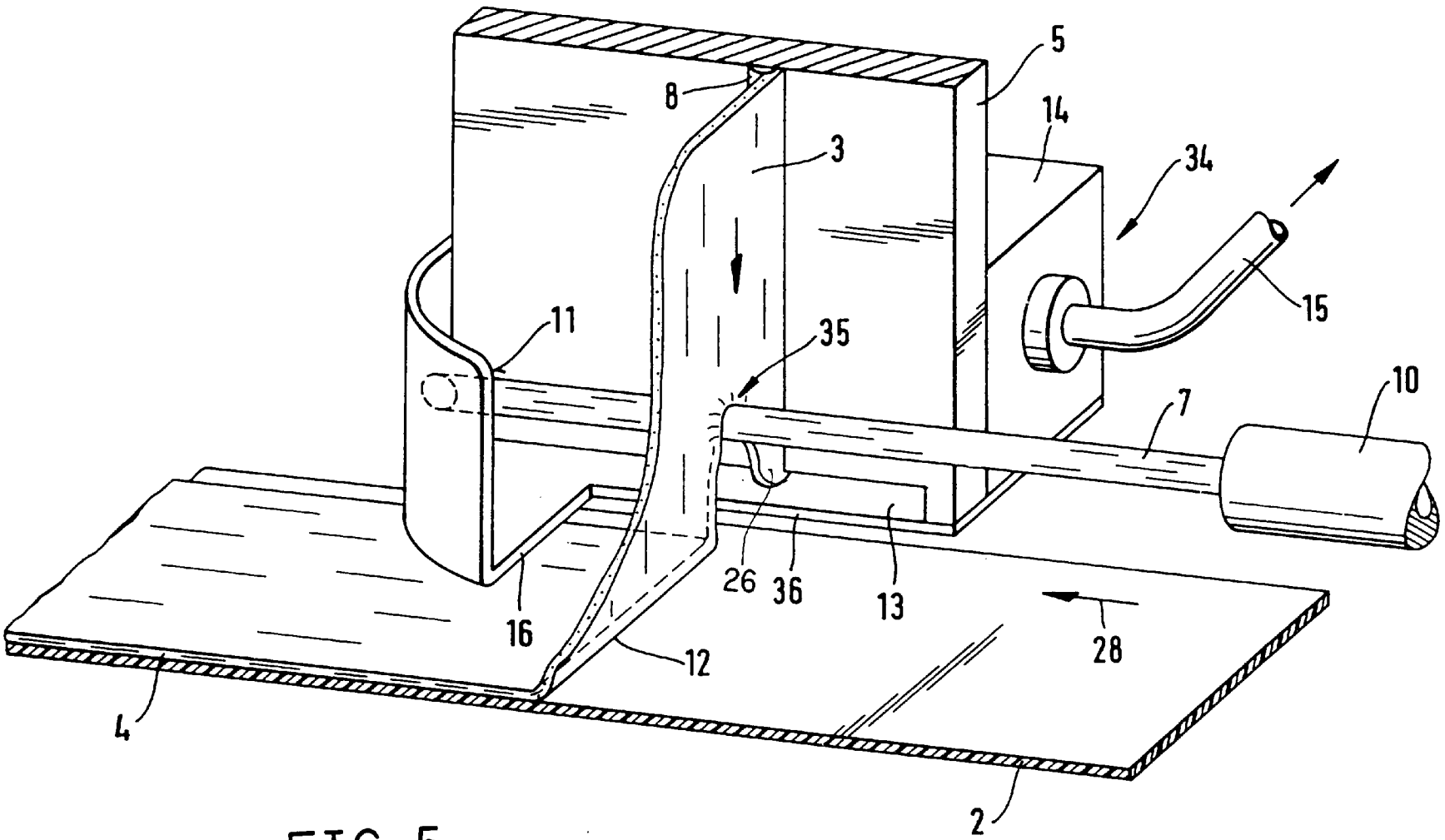
FIG. 5 shows a three-dimensional detail view of a flat curtain holder having the separating device and the vacuum device next to the base.

FIG. 5 shows in detail the free jet 7 separating one of the two curtain edges 26. To better show the free-falling parts resulting from dividing the curtain 3, the distance from the free jet 7 to the base 2 is greatly exaggerated. The free jet 7 is cylindrical in the instance shown. It issues from the nozzle 10, penetrates the liquid curtain 3 in the penetration zone 35, and impinges on the deflector 11. The free path of the penetrating jet 7, measured from the nozzle mouth to the deflector is preferably about 3 cm. In the embodiment shown, the deflector 11 is part of the vacuum device 34, the housing 14 of which is attached to the flat curtain holder 5. A bottom wall 36 of the housing 14 extends attached to a bottom wall 16, which is connected to the deflector 11. The deflector 11 and the housing 14 can be made, for example, of a sheet of metal or plastic. The deflector 11 does not have to be curved as shown, but can be any shape, for example, an angularly folded wall. The deflector 11 must be able to withstand the force of the jet impact. The separating liquid of free jet 7 can also be drained away by entirely different means, for example, a tube (not shown) having an opening to receive the jet. Any device is suitable if it can collect the separating liquid so that it does not cause turbulence in the curtain 3 or in the coating formation 4. The rectangular vacuum slot 13 forms a recess in the flat curtain holder 5 in the embodiment shown. The vacuum slot 13 is positioned very close to the base 2. The preferred spacing is less than 0.5 mm between the bottom wall 36 and the base 2, and the bottom wall 36 is less than 0.2 mm thick. This results in the penetration zone 35 seeing an advantageous field of air streaming into the vacuum slot 13. The flow vector of the air on both sides of the liquid curtain 3 then is parallel to the plane of the liquid curtain 3. Also, as shown in this FIG. 5, the space above the jet 7 is left open. This is especially desirable for the curtain 3, because the pressure gradient field in the deflection area is parallel to the plane of the curtain 3. Therefore, the coating step is not disturbed. The distance of the free jet 7 from the base 2 should be selected to be as small as possible. In practice, a spacing of 0.5 mm has proven to be advantageous. The perspective in FIG. 5 shows the base 2 as a flat web. The base 2 is transported in the direction of the arrow 28. The contact line 12 of the coating 4 on the base 2 thus lies on a flat area. However, in practice, the coating step takes place mostly over the coating roller 1, as depicted in FIG. 3. The base 2 is therefore curved in this section, as is shown in FIG. 3. In this figure, the contact line 12 would correspond to the 12 o'clock position of the coating roller 1 in FIG. 3. In practice, an upstream contact point has proven to be desirable.

Figure 6:
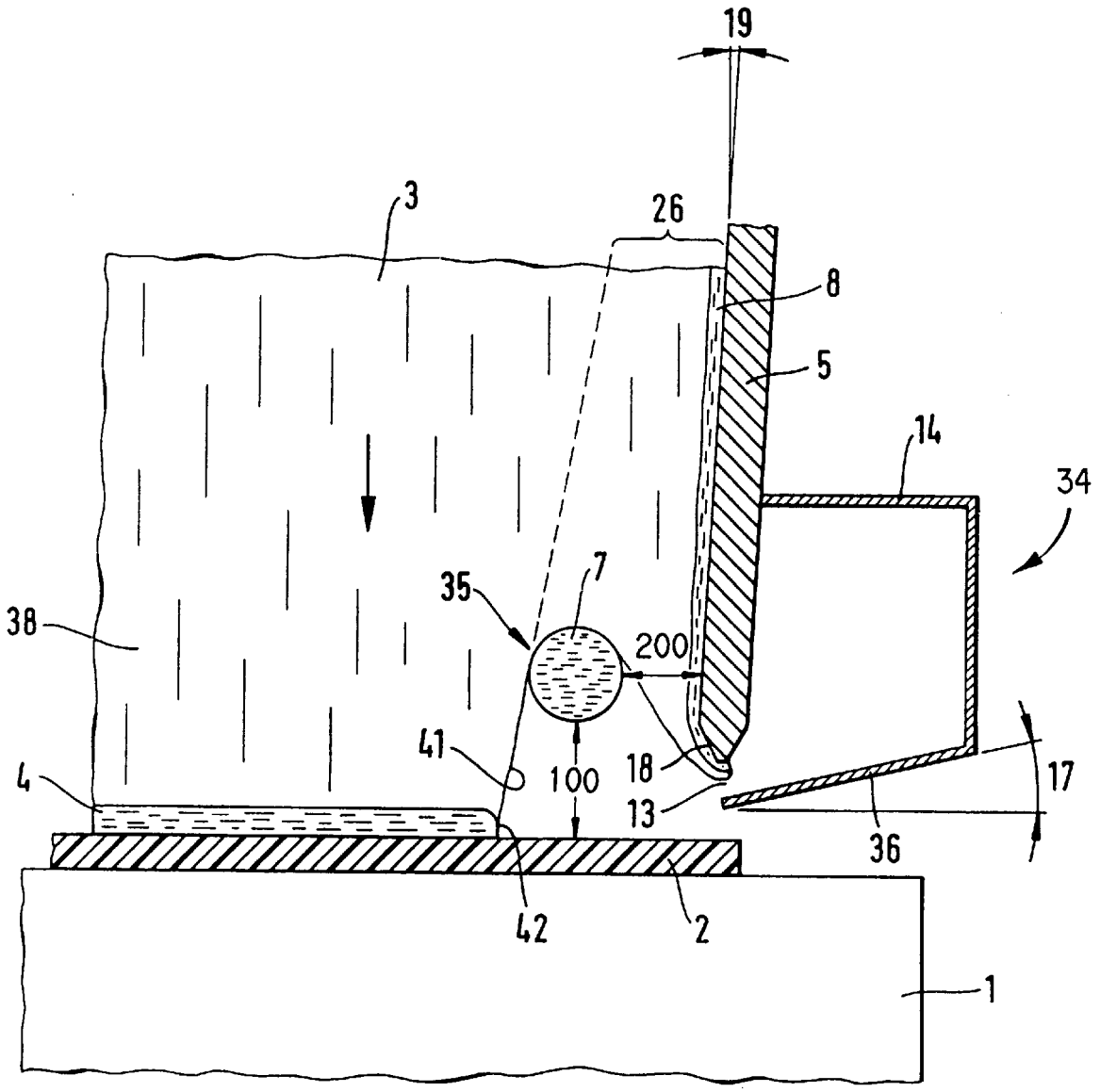
FIG. 6 shows a transverse section of a flat curtain holder with a vacuum device and a circular free jet seen against the travel direction of the base.

In FIG. 6, the curtain holder 5 is tilted from the vertical by an incline angle 19. This incline angle 19 is preferably between 0 and 5°, a 3° angle being especially preferred. This incline in the curtain holder 5 decreases susceptibility to defects in the liquid curtain 3. The bottom wall 36 of the housing 14 of the vacuum device 34 is also shown inclined from the horizontal toward the curtain holder 5 by an angle 17. It has been shown in practice that the angle 17 of the bottom wall 36 is preferably between 0 and 30°. According to the invention, the free fall of the curtain 3 is not interrupted by a projecting blade. The cross-section of the free jet 7 is circular. The distance 100 from the free jet 7 to the base 2 should be, as mentioned previously, as short as possible. (This distance 100 corresponds to the distance B in the formula above.) In the industrial embodiment, this distance is 0.5 mm. The distance 200 from the free jet 7 to the curtain holder 5 is maintained at about 5 mm. (This distance 200 corresponds to the distance A in the formula above.) The narrowing, designated as contraction, occurs in this space. The curtain edge 26 is thus a strip of the curtain 3 several millimeters wide. It runs along the drop, increasing in distance from the curtain holder. At the foot of the curtain, the strip is about 4–8 mm wide. The free jet 7 separates from the liquid curtain 3, the free-falling curtain center 38, and an edge 41 of which narrows. On contacting the base 2, the curtain center 38 forms the coating 4. Edge 42 of the coating 4 shows almost no beading. The curtain edge 26 freely falls farther after the penetration zone 35 and is picked up by the vacuum slot 13 due to the reduced pressure in the interior of the housing 14. A reduced pressure of 180 mbar in the interior of the housing 14 has proven to be favorable if the vacuum slot 13 is rectangular, about 35 mm wide, and 2 mm high. The bottom wall 36 is 0.1 mm thick. The bottom wall 36 does not project into the curtain 3. The vacuuming of the curtain edge 26 is especially good in connection with taper 18 if, as shown in the figure, the bottom wall 36 is inclined toward the curtain holder 5. The taper 18 can be, for example, a bevel of 2 mm for 5 mm, or can be rounded.

Figure 7:
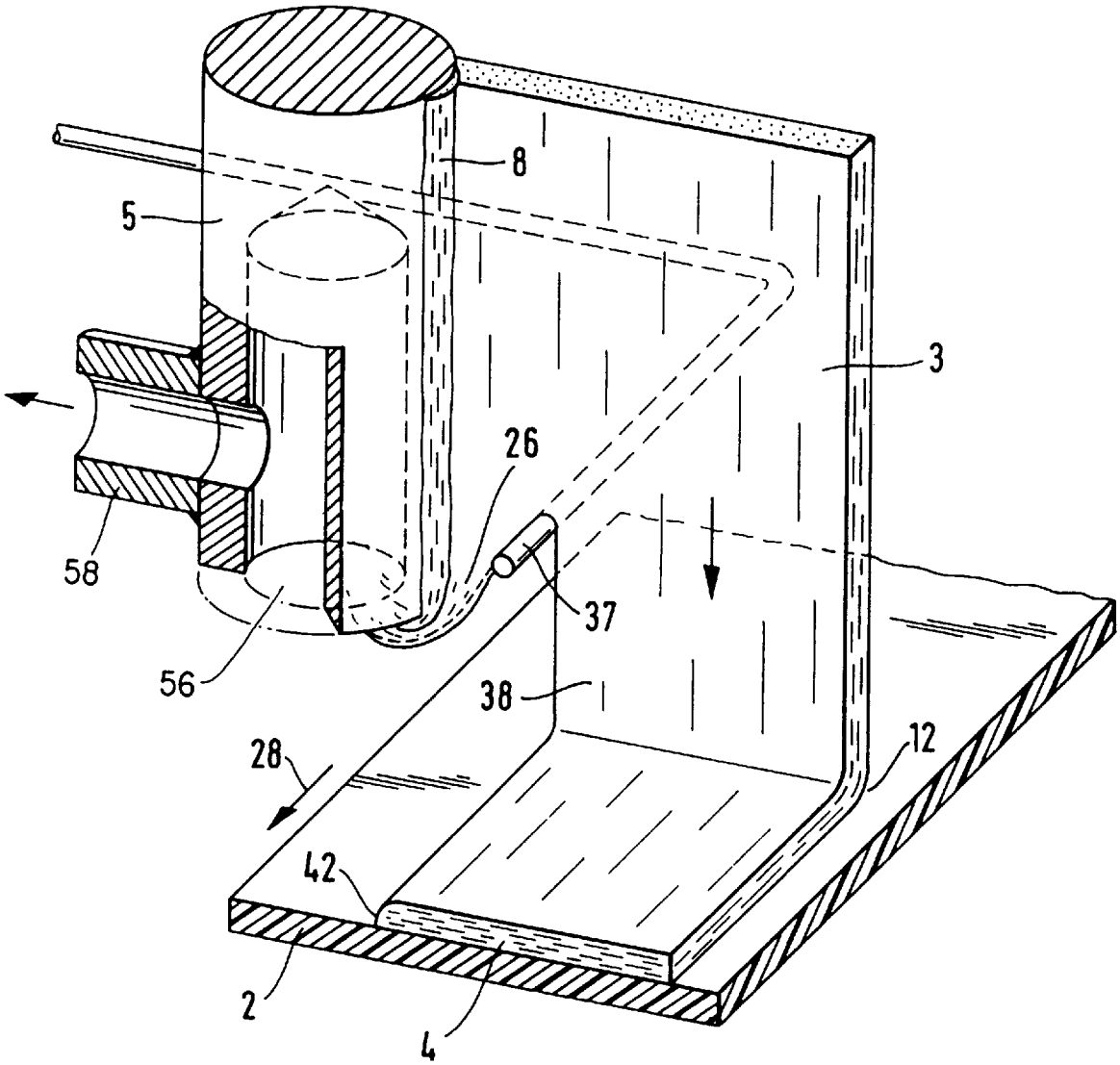
FIG. 7 shows a three-dimensional view of a circular curtain holder with a vacuum device and a bar-shaped separating element.

FIG. 7 shows an embodiment of the invention having a cylindrical curtain holder 5. The separating element is a cylindrical bar 37. In this especially simple embodiment of the invention, the curtain 3 can also be divided into two freely falling parts. The curtain center 38 forms the coating 4 on the base 2. The curtain edge 26 is vacuumed away. The curtain holder 5 shown has a diameter of 3 mm and a 2 mm hole in its underside. The hole forms at the foot of the curtain holder 5 the vacuum aperture 56 connected with the line 58. The line 58 connects with a vacuum device, not shown. However, the cylindrical bar 37 does not perform as well as the free jet 7 from the standpoint of turbulence in the liquid flow. The turbulence affects the curtain 3 more than in the case of the separating jet 7.

Figure 8:
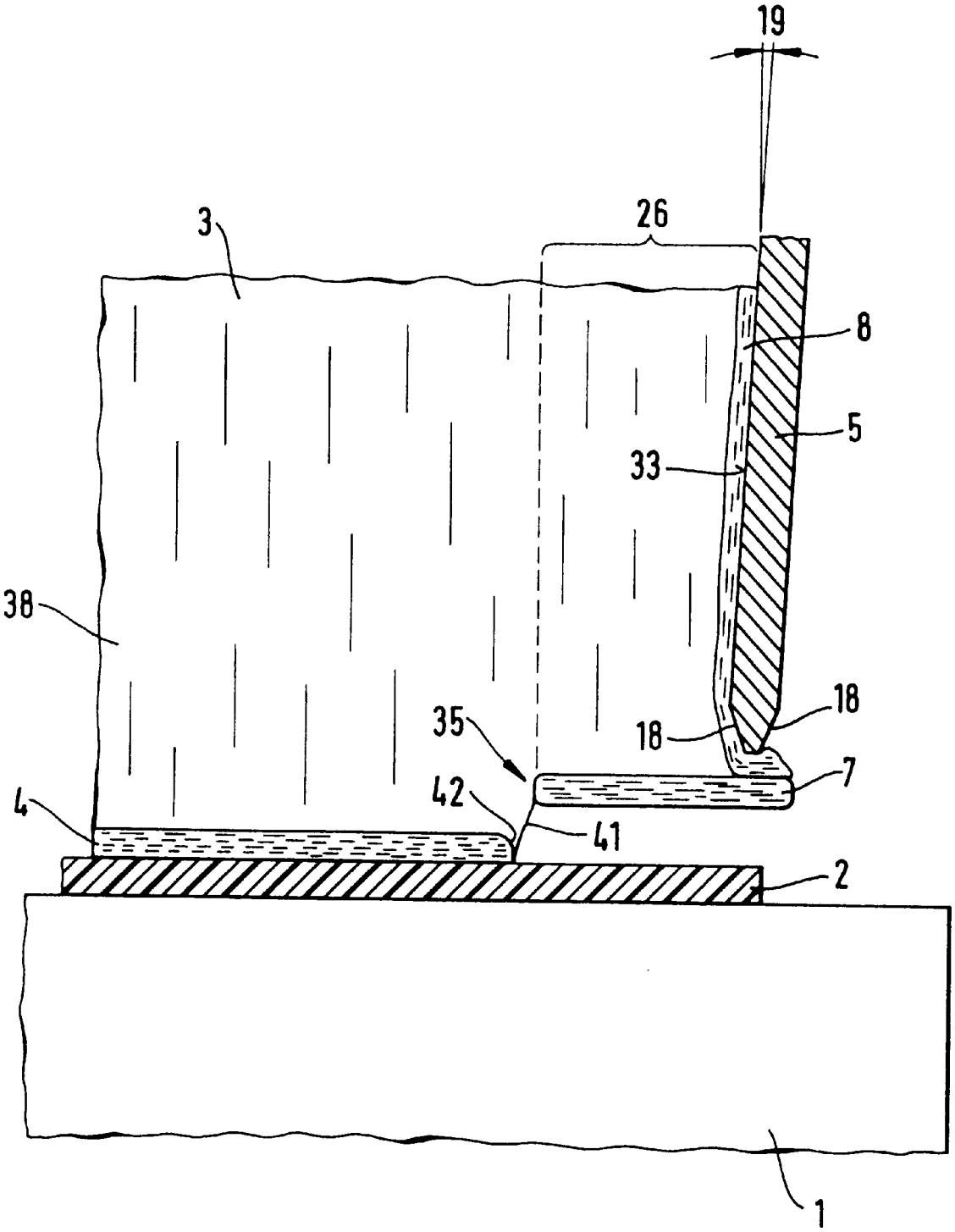
FIG. 8 shows a transverse view of a flat curtain holder with a rectangular free jet seen against the travel direction of the base.

FIG. 8 shows another principal concept of the invention. The free jet 7 is a flat jet with a rectangular cross-section. The flat jet 7 operates as an interceptor and intercepts the curtain edge 26 before it reaches its objective, that is, before it contacts the base 2. In the especially preferred embodiment shown, this flat jet is 5 mm long and travels essentially parallel to the base 2. The flat jet 7 is about 0.5 mm away from the base 2 and is 0.2 mm thick. The flat jet 7 is produced from a nozzle with a rectangular mouth (not shown). The curtain holder 5 is a metal plate inclined to angle 19 from the vertical. An area 33 lying on the curtain 3 is wetted by the auxiliary liquid 8 that also wets the curtain edge 26. As shown in FIG. 8, the curtain holder 5 terminates just above the flat jet 7. The foot of the curtain holder 5 has a beveled taper 18. The flat jet 7 separates the curtain 3 without the disadvantages of a rigid interceptor. The curtain edge 26 is intercepted so that only the curtain center 38 coats the base 2. The curtain edge 26 drops on the upper long side of the flat jet 7 and is mixed with its separating liquid. The kinetic energy of the flat jet 7 deflects the liquid flow of the curtain edge 26 and carries it away. No other means are required to divert the curtain edge 26 from the base 2. The free jet 7 itself assumes this function. The curtain 3 is thinner in the penetration zone 35, as with the cylindrical free jet, because here, too, liquid is withdrawn from the curtain 3. This applies as stated for the cylindrical free jet. The coating 4 is uniform on the base 2.

Figure 9:
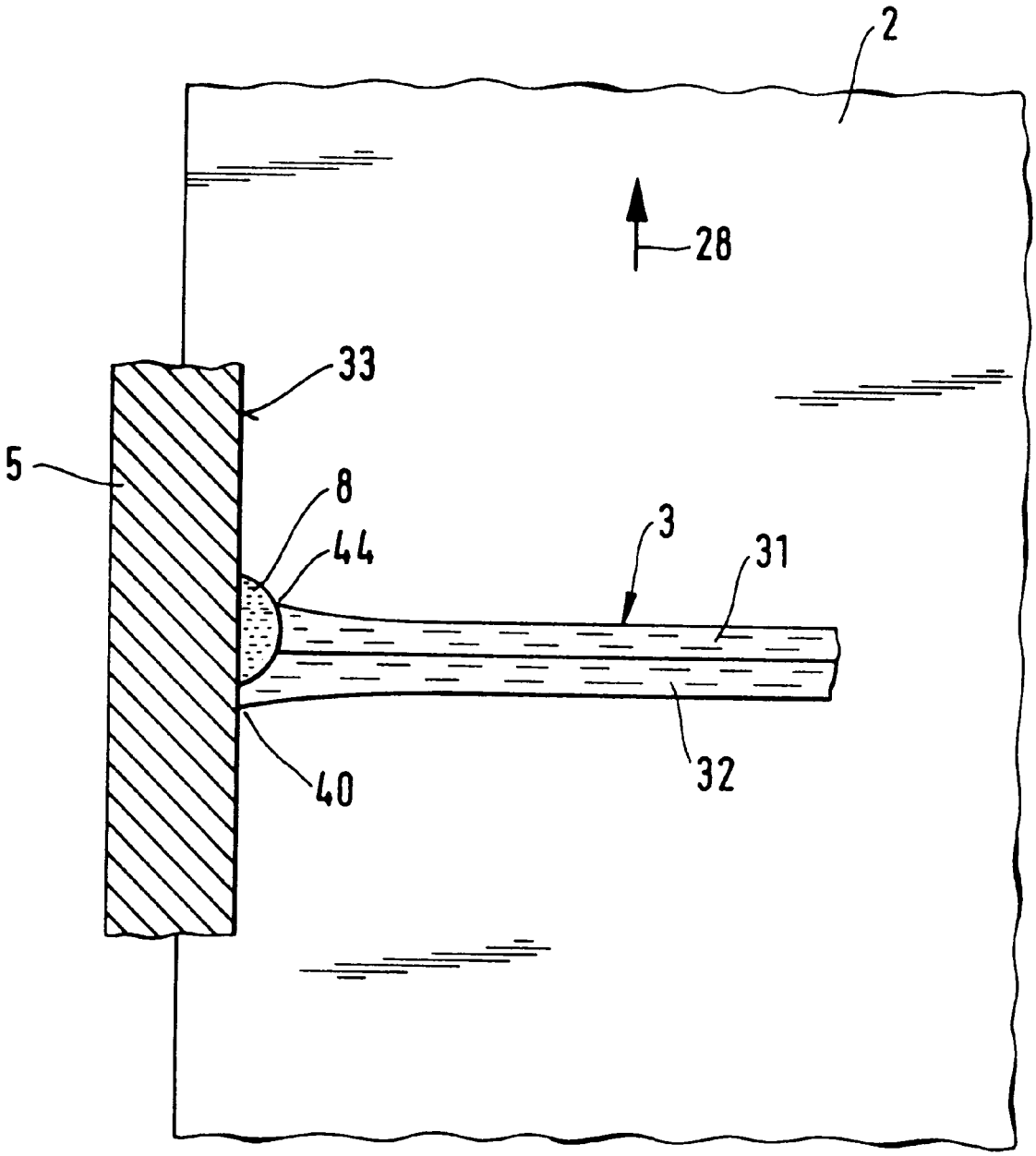
FIG. 9 shows a transverse view of a flat curtain holder viewed toward the coating side of the base.

FIG. 9 shows in detail the wetting of the curtain 3 on the curtain holder 5. The auxiliary liquid 8 forms a free-flowing liquid stream on the area 33 of the curtain holder 5. The curtain 3 wets the area 33 of the curtain holder 5 at a contact line 40 lying upstream, as seen here, from the travel direction 28 of the base 2. A downstream contact line 44 lies on the auxiliary liquid 8. In this drawing, the curtain 3 comprises layer 32 and layer 31. The curtain 3 can comprise, as mentioned previously, several layers. The layers can be formed from photosensitive or photoinsensitive coating solutions. The area 33 on which on the curtain 3 lies is planar. The curtain 3 and the auxiliary liquid 8 are freely mobile in the travel direction of the web. This degree of freedom in the liquid curtain 3 works favorably from the standpoint of reducing susceptibility to turbulence.

EXAMPLES

Figure 10:
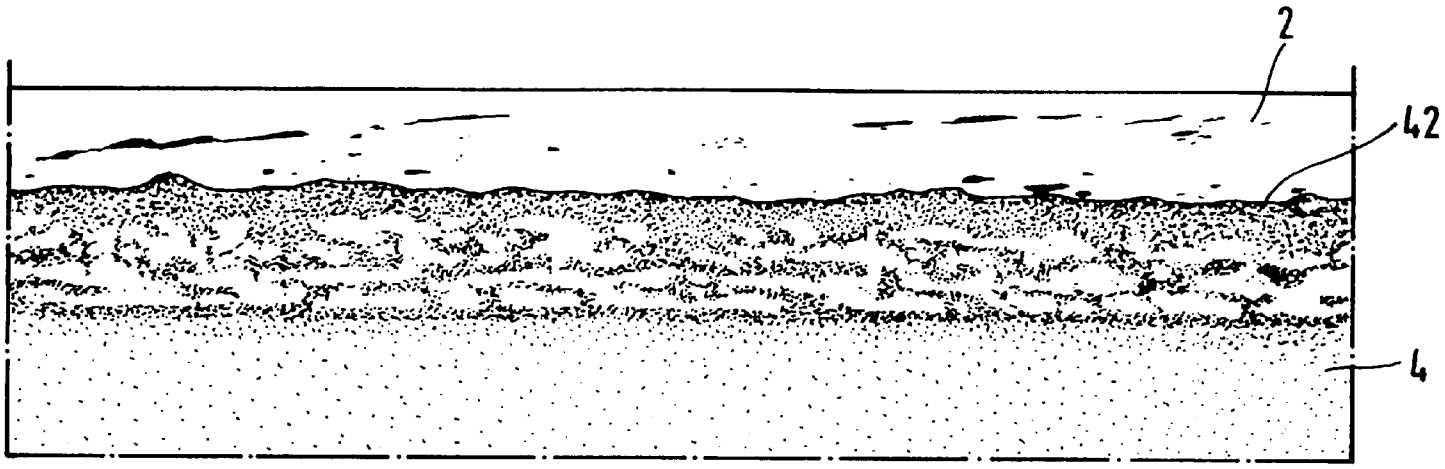
FIG. 10 shows a coating edge made without the curtain edge having been severed according to the invention.
Figure 11:
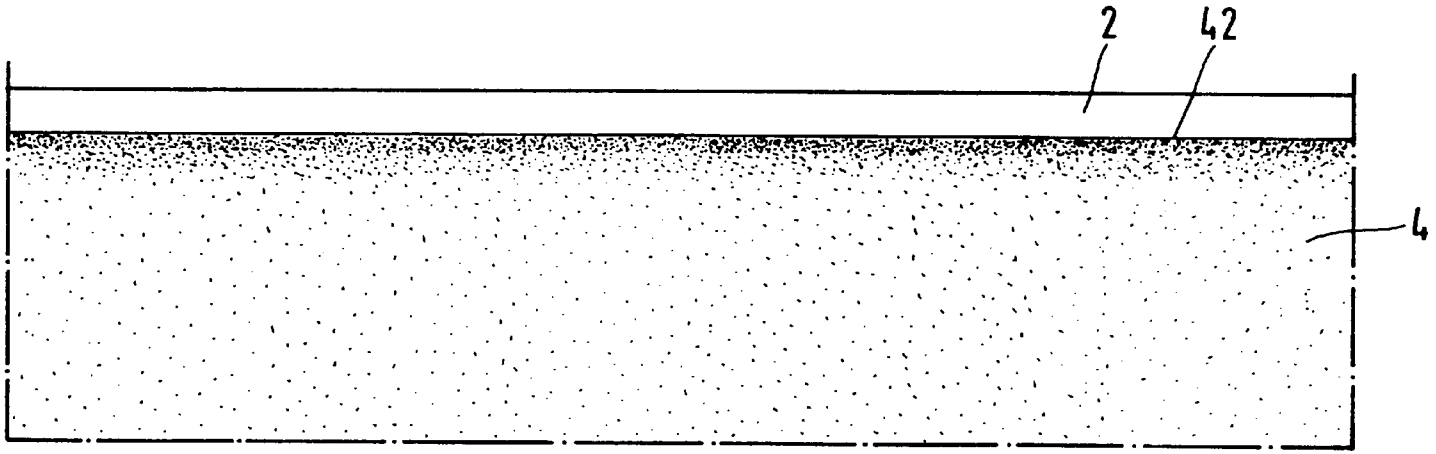
FIG. 11 shows a coating edge made by using the invention's separating device.

FIGS. 10 and 11 show the coating edges of a comparison example. A curtain coater with a drop height of 15 cm was used. The coating solution was a photographic coating solution having 9% by weight gelatin. The web speed was 260 m/min. FIG. 10 shows a coating edge obtained with a flat conventional curtain holder without the invention's method of separating the curtain edges. A cylindrical free jet according to the invention was used in FIG. 11. The edge runs uniformly and shows only a slight thickening.

A flat curtain holder is preferred for use in the present invention. The curtain has an additional degree of freedom in the web's travel direction. The flat curtain holder permits to a limited extent curtain mobility in and against the web's travel direction. Low frequency oscillations, originating from ambient air flows, are tolerated but simultaneously dampened smoothly. Operating performance is significantly improved, especially at high coating speeds. Advantages are also apparent when starting up the curtain-coating process.

Obviously, the invention is not limited to this type of curtain holder. The advantageous separating action is achieved with any type of curtain holder, for example, curtain holders made of thin wires or bars. The invention is, of course, also not limited to the slide surface coater or to photographic coating solutions. The separating process of the invention can also be used on extrusion coaters having curtains guided by curtain holders. The curtain can be, for example, a photopolymer. The separating liquid can be a solvent. Any web-shaped material can be used as the base.

What is claimed is:

1. A process for curtain-coating a base with at least one layer of a coating solution, in a coating zone of which process a free-falling liquid curtain comprising one or more layers of coating solutions is formed, the liquid curtain has a length, the process comprising the steps of (a) wetting curtain holders with the liquid curtain at curtain edges (b) spreading and holding the liquid curtain between the curtain holders during free fall of the liquid curtain, (c) passing a web-shaped base continuously through the coating zone, and the curtain edges are separated from the liquid curtain and conducted away, characterized by the steps of (d) removing the curtain edges by a separating element that penetrates the plane of the liquid curtain in a penetration zone in the immediate vicinity of a base and next to the curtain holders, and wherein the separating element is a free jet of a separating liquid, the flow speed of the free jet is greater than the drop speed of the liquid curtain in the penetration zone and greater than the speed of the base and (e) splitting the liquid curtain with the separating element at the penetration zone into a free-falling curtain center and free-falling curtain edges and wherein only the curtain center coats the base;

wherein the curtain holders extend to substantially the entire length of the liquid curtain.

2. The process according to claim 1, characterized in that the flow of the free jet and the transport direction of the base run essentially parallel.

3. The process according to claim 1, characterized in that the form of the free jet in the penetration zone is essentially a cylinder and the diameter of the cylinder is about twice the thickness of the liquid curtain.

4. The process according to claim 1, characterized in that the flow speed of the free jet is five times greater than the drop speed of the liquid curtain in the penetration zone and the penetration zone is in an area of contraction of the liquid curtain.

5. The process according to claim 1, characterized in that the separating liquid is water and has the same temperature as the liquid curtain.

6. A process for curtain-coating a base with at least one layer of a coating solution, in a coating zone of which process a free-falling liquid curtain comprising one or more layers of coating solutions is formed, the process comprising the steps of (a) wetting curtain holders with the liquid curtain at curtain edges (b) spreading and holding the liquid curtain between the curtain holders during free fall of the liquid curtain, (c) passing a web-shaped base continuously through the coating zone, and the curtain edges are separated from the liquid curtain and conducted away, characterized by a flat free jet intercepting and conducting away the curtain edge and only the free-falling curtain center coating the base.

7. The process of claim 1 or 6 characterized in that the curtain holders are further wet by an auxiliary liquid.

8. A curtain-coater to coat a web-shaped base with at least one coating liquid, comprising (a) a transport device to move and guide the base through a coating zone, (b) a coating head to make a liquid curtain that drops freely onto the coating side of the base wherein the base is wider than the liquid curtain, wherein the liquid curtain has a length, (c) two curtain holders that spread and hold the free-falling liquid curtain at the curtain edges, wherein the curtain holders extend to substantially the entire length of the liquid curtain, (d) free jet means for separating the liquid curtain into a free-falling curtain center and into free-falling curtain edges, said jet having a circular cross-section and (e) means for removing the curtain edges before contact with the base so that only the curtain center coats the base.

9. The curtain-coater according to claim 8, characterized in that the separating liquid is water, which is vacuumed up together with the curtain edges by a vacuum device at a distance of less than 0.5 mm from the base, and conducted away from the base.

10. The curtain-coater according to claim 8, characterized in that the curtain holders have a flat area on which the liquid curtain lies, where the curtain edges wet the curtain holders.

11. The curtain-coater according to claim 8 or 10, characterized in that means to supply an auxiliary liquid is provided so that the auxiliary liquid forms a free-flowing liquid stream to the area of the curtain holder on which lies the liquid curtain and the liquid stream wets the curtain edges and the flat area.

12. The curtain-coater according to claim 10, characterized in that the flat area of the curtain holder on which lies the liquid curtain parallels the travel direction of the web and is inclined at a 3° angle from the vertical.

13. The curtain-coater according to claim 8, characterized in that the free jet issues from a nozzle, penetrates through the liquid curtain in a penetration zone onto a deflector, and the curtain edges and the separating liquid are vacuumed into a slot in the vacuum device.

14. The curtain-coater according to claim 13, characterized in that the vacuum device has a housing having a bottom wall inclined at an angle.

15. The curtain-coater according to claim 8, characterized in that the curtain holder has a taper on the lower end.

16. The curtain-coater according to claim 8, characterized in that the liquid curtain meets the base along a contact line, and a tangential plane to the contact line of the base parallels the free jet, and the distance between the free jet and the contact line is equal to or less than 0.5 mm.

17. The curtain-coater according to claim 16, characterized in that a distance B from the free jet to the base and a distance A from the free jet to the curtain holder fulfill the following relationship:

$$0<B/A\leq 5.$$

* * * * *